US005383251A

United States Patent [19]

Whitaker et al.

[11] Patent Number: 5,383,251

[45] Date of Patent: Jan. 24, 1995

[54] FLOOR SCRUBBER HAVING INTERLOCKING TANKS

[75] Inventors: Emert R. Whitaker, Siloam Springs; Trent A. Fulghum, Fayetteville; James J. Keazer, Rogers; James A. Pritchett, Summers, all of Ark.

[73] Assignee: Clarke Industries, Inc., Springdale, Ark.

[21] Appl. No.: 184,959

[22] Filed: Jan. 21, 1994

[51] Int. Cl.[6] ..... A47L 11/30

[52] U.S. Cl. ..... 15/320; 15/352; 15/353

[58] Field of Search ..... 15/320, 353, 352

[56] References Cited

U.S. PATENT DOCUMENTS

| | | | |
|---|---|---|---|
| 3,277,511 | 10/1966 | Little et al. | 15/320 |
| 3,376,597 | 4/1968 | Boyd | 15/320 |
| 3,866,541 | 2/1975 | O'Connor et al. | 15/320 X |
| 4,107,813 | 8/1978 | Torres | 15/246 |
| 4,333,202 | 6/1982 | Block | 15/320 |
| 4,464,810 | 8/1984 | Karpanty | 15/320 |
| 4,492,002 | 1/1985 | Waldhauser et al. | 15/320 |
| 4,696,074 | 9/1987 | Cavalli | 15/321 |
| 4,759,094 | 7/1988 | Palmer et al. | 15/320 |
| 4,776,058 | 10/1988 | Garner et al. | 15/320 |
| 4,809,397 | 3/1989 | Jacobs et al. | 15/320 |
| 5,063,633 | 11/1991 | Ingermann et al. | 15/320 |
| 5,155,876 | 10/1992 | Whitaker | 15/320 |
| 5,237,719 | 8/1993 | Dwyer et al. | 15/320 X |
| 5,319,828 | 6/1994 | Waldhauser et al. | 15/320 |

OTHER PUBLICATIONS

Advertising Brochure for Clarke Vision, Clarke Industries, Inc., St. Louis, Missouri.

*Primary Examiner*—Christopher K. Moore

*Attorney, Agent, or Firm*—Herzog, Crebs & McGhee

[57] ABSTRACT

A self-propelled floor cleaning machine or scrubber of the walk-behind type includes a one-piece molded main body incorporating an integral solution tank. The main body includes a central cavity in which is received a one-piece molded secondary body defining a recovery tank. The main body receives the secondary body in an interlocking fashion such that the entire unit is self-supporting, such that the use of gaskets or sealers between the tanks and other components is eliminated. The main body is supported on a steel frame which also supports the batteries, cables, wheels, brushes, squeegee, and the like (frame components). The main body fits over the frame components and together with the secondary body provides a water shedding cover therefore.

9 Claims, 4 Drawing Sheets

FLOOR SCRUBBER HAVING INTERLOCKING TANKS

BACKGROUND OF THE INVENTION

1. FIELD OF THE INVENTION

The present invention relates generally to floor cleaning machines or scrubbers and, more particularly to the construction of solution and recovery tanks in self-propelled floor scrubbers.

2. Description of the Prior Art

In order to clean and maintain large floor areas such as are found in office buildings, supermarkets, warehouses, factories, and the like, it has become common practice to utilize floor cleaning or scrubbing machines. Such floor cleaning machines have generally evolved into what is known as self-propelled floor scrubbers that are steered or commanded by an operator who walks behind the machine.

As is well known in the art, these self-propelled floor scrubbers generally include one or two motors respectively driving one or two brushes or pads that are mounted underneath and near the front of machine in overlapping relationship. A liquid solution in the form of water or water and detergent is furnished to the brushes from a solution or supply tank, with the solution generally supplied through the brushes for application onto the floor. The floor scrubbers also include a squeegee assembly disposed to the rear of the brushes operating in conjunction with a vacuum system. Also, there is provided with an automatic driving means for propelling the machine along the floor so that the operator need not manually push the machine, only steer it and operate the controls. To this end, the floor scrubbers are generally powered by batteries, being either 24 or 36-volt systems.

In operation, the desired cleaning solution is loaded into the solution tank. The solution is discharged through the brushes via a discharge tube for application onto the floor, and is thereafter spread and agitated with the brushes. This action scrubs the floor a little at a time during which the floor scrubber moves across the floor. As the machine passes over the scrubbed area with the solution disposed thereon the squeegee system with the vacuum collects the dirty solution and deposits it in the onboard recovery or storage tank.

Accordingly, these floor scrubber machines eliminate the need for manual washing and vacuuming, wherein one person mops the floor while the other person operates a wet vacuum to recover the solution that the mopping person has laid down.

While machines of this general nature have been known in the prior art, there are an increasing number of requirements or regulations that such machines must meet before they are approved for commercial use. One such requirement relates to water shedding. The machine needs to be watertight such that nothing may enter the solution or recovery tanks, or the batteries and wiring which is located within the body or frame. In the prior art this is accomplished by providing gaskets or similar sealing arrangements between the tank structures and the body or frame as the tank structures are generally formed as two separate components.

However, such sealing structures are generally unreliable after a period of time and use. Furthermore, such sealing structures are subject to stress and strain which can cause failure. Such failure can lead to water entering into the housing structure which can damage the electrical system and internal components. Also, such water may enter the solution or recovery tanks.

It is thus an object of the present invention to provide a floor scrubber housing that is watertight in order to protect the internal components against water intrusion.

It is also an object of the present invention to provide a floor scrubber which is free of gaskets or other similar sealers between the barriers formed between the recovery tank housing and the solution tank housing.

SUMMARY OF THE INVENTION

The present invention provides a water-proof solution and recovery tank housing comprising a one-piece molded main body incorporating an integral solution tank. The main body includes a central cavity in which is received a one-piece molded secondary body defining a recovery tank. The main body receives he secondary body in an interlocking fashion such that the use of gaskets or sealers between the tanks and other components is eliminated, the main body and the secondary body together forming a water-shedding housing.

In one form thereof the present invention provides a self-propelled, walk-behind floor scrubber having a frame supported by a powered wheel and a rotatable brush supported on a front portion of the frame and adapted to contact and clean a floor surface. A one-piece molded housing is supported on the frame, the one-piece molded housing having an integrally formed solution tank for storing a cleaning solution, and a central opening, the one-piece molded housing further defining an interior cavity. The floor scrubber further includes a one-piece molded body defining a recovery tank, the one-piece body receivable in and supported by the central opening. The central opening includes inwardly extending ledges with the one-piece body including complementary inwardly extending surfaces adapted to interlockingly engage the ledges to form a water-shedding cover about the interior cavity. A solution application system is in communication with the brush and the solution tank for supplying the cleaning solution to the brush from the solution tank for application onto the floor. Also, a suction system is in communication with the floor and the recovery tank for transferring spent cleaning solution on the floor to the recovery tank as the floor scrubber moves in the direction of the brush.

In another form thereof, the present invention provides a water-tight housing structure for a floor scrubber. The housing structure comprises a one-piece molded body constituting a main housing having an opening in an upper surface thereof, and an integrally formed solution tank for storing a cleaning solution. The main housing together with a floor scrubber chassis defines an interior chamber, with the opening having a lip disposed on the inner periphery thereof. A one-piece molded recovery tank is adapted to fit into and cover the opening. The tank having a rib disposed on an outside surface thereof and defining a recess, the rib and recess adapted to interlockingly engage the lip such that the body and the recovery tank form a water-shedding housing structure around the interior chamber.

Further, the opening is defined by a first pair of opposing walls and a second pair of opposing walls. The lip extends longitudinally on the first pair of opposing walls and forms an inverted V-shape on one of said second pair of opposing walls. The rib forms an inverted V-shape on one end of the recovery tank adapted to complementarily engage the inverted V-shaped lip.

BRIEF DESCRIPTION OF THE DRAWINGS

So that the manner in which the above-recited features, advantages, and objects of the present invention are attained and can be understood in detail, a more particular description of the invention, briefly summarized above, may be had by reference to the embodiments thereof which are illustrated in the appended drawings. Corresponding reference characters indicate corresponding parts through the several view.

It is noted, however, that the appended drawings illustrate only a typical embodiment of this invention and is therefore not to be considered limiting of its scope, for the invention may admit to other equally effective embodiments. Reference the appended drawings, wherein.

DESCRIPTION OF THE PREFERRED EMBODIMENT

Figure 1:
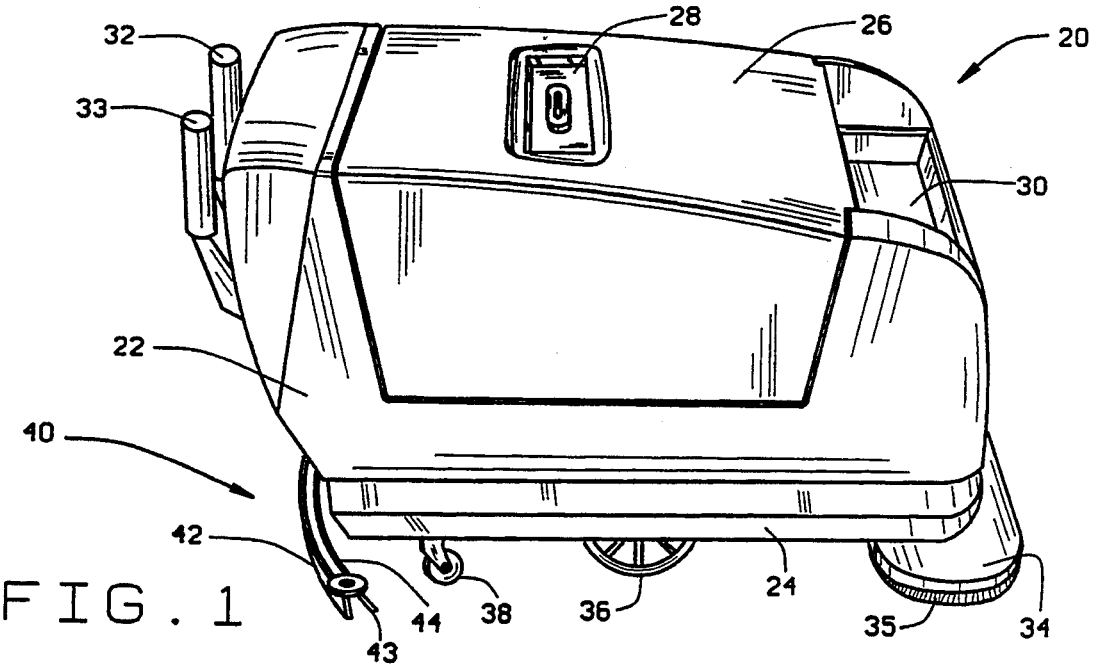
FIG. 1 is an elevational view of a floor scrubber embodying the present invention.

Referring now to FIG. 1 there is shown a self-propelled walk-behind floor scrubber generally designated 20. The floor scrubber 20 includes a main body 22 that is disposed on a chassis or frame 24 and includes a solution tank opening 30 disposed at the front end thereof. In the preferred form, the main body 22 is a one-piece body molded from a suitable plastic or fiberglass and fits over and onto chassis 24. Disposed in the main body 22 as hereinafter described is a recovery tank 26 having a covered opening 28. Two handles 32, 33 are mounted at the rear end of main body 22. The handles 32, 33 are grasped by the operator and are used to guide the floor scrubber during operation thereof. Chassis 24 is a rigid structure preferably fabricated from a metal such as, for example, steel, although other suitable materials may be utilized.

Figure 3:
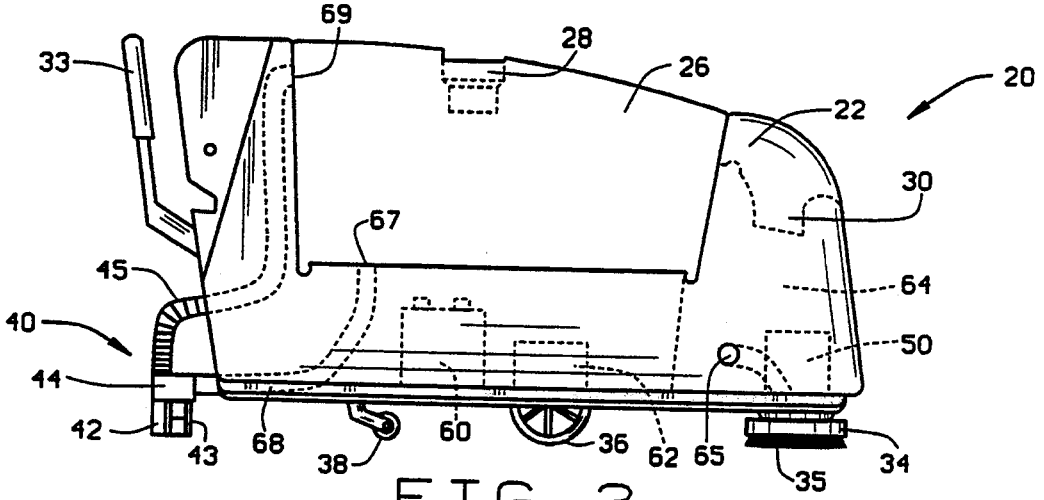
FIG. 3 is a side view of the floor scrubber showing some of the internal components in phantom.

Disposed on the underside of chassis 24 is a brush housing 34 carrying one or a pair of rotatable brushes of which only one brush 35 is shown. The brush housing 34 is limitedly, pivotably coupled to chassis 24 such that the brush housing 34 may move independently of chassis 24. As is best seen in FIG. 3, brush 35 is operably connected to a brush motor 50 such that brush motor 50 rotates brush 35 during operation of the floor scrubber 20. The other brushes (not shown) may likewise be coupled to brush motors (not shown). A drive wheel 36 is also disposed on the underside of chassis 24 rearwardly of the brush housing 34 and is coupled to a drive motor 62. Drive wheel 36 is thus driven by the drive motor during operation of the floor scrubber 20 such that the floor scrubber 20 is self-propelled. The operator of the floor scrubber 20 needs only to steer the direction and is accomplished by grasping of the handles 32, 33. Disposed rearwardly of drive wheel 36 are a pair of spaced apart support or steer wheels or casters of which only one wheel 38 is shown. The pair of support wheels provides stability to floor scrubber 20. Located at the rear portion of floor scrubber 20 and attached to the chassis 24 is a squeegee system 40 having two elongated spaced-apart rubber blades 42, 43 fixed to an elongated spacer 44. The spacer 44 and the blades 42, 43 define a suction chamber therebetween that is in communication with a suction hose or conduit 45 (FIG. 3) that is in fluid communication with recovery tank 26.

The general layout of the internal components of the present floor scrubber 20 and the operation thereof is now described with the aid of FIG. 3. Supported by floor 47 are storage batteries of which only one storage battery 60 (FIG. 3) is shown, as well as a drive motor 62 (FIG. 3) that is drivingly coupled to drive wheel 36 and to the batteries for supplying electromotive power. Solution tank 64 which is integrally formed with main body 22, includes an outlet port 65. A solution conduit 65 is coupled to outlet port 65 providing fluid communication between the interior of solution tank 30 and brush housing 34. In this manner, a controlled quantity of solution stored within solution tank 64 may be fed or released into the brush housing 34 for application onto the floor via the brushes 35. Recovery tank 26 is in fluid communication with squeegee system 40 via inlet port 69 to which is coupled suction conduit 45. A suction producing means, typically a vacuum motor (not shown), is provided for creating suction within suction conduit 45 and thus squeegee system 40 in order to recover the liquid solution and otherwise deposited on the floor from the solution tank. The spent liquid is retained in the recovery tank 26 until the recovery tank 26 is full and, thus, ready to be drained. An outlet port 67 coupled to an outlet conduit 68 provides a fluid path for draining the contents of recovery tank 26.

Figure 2:
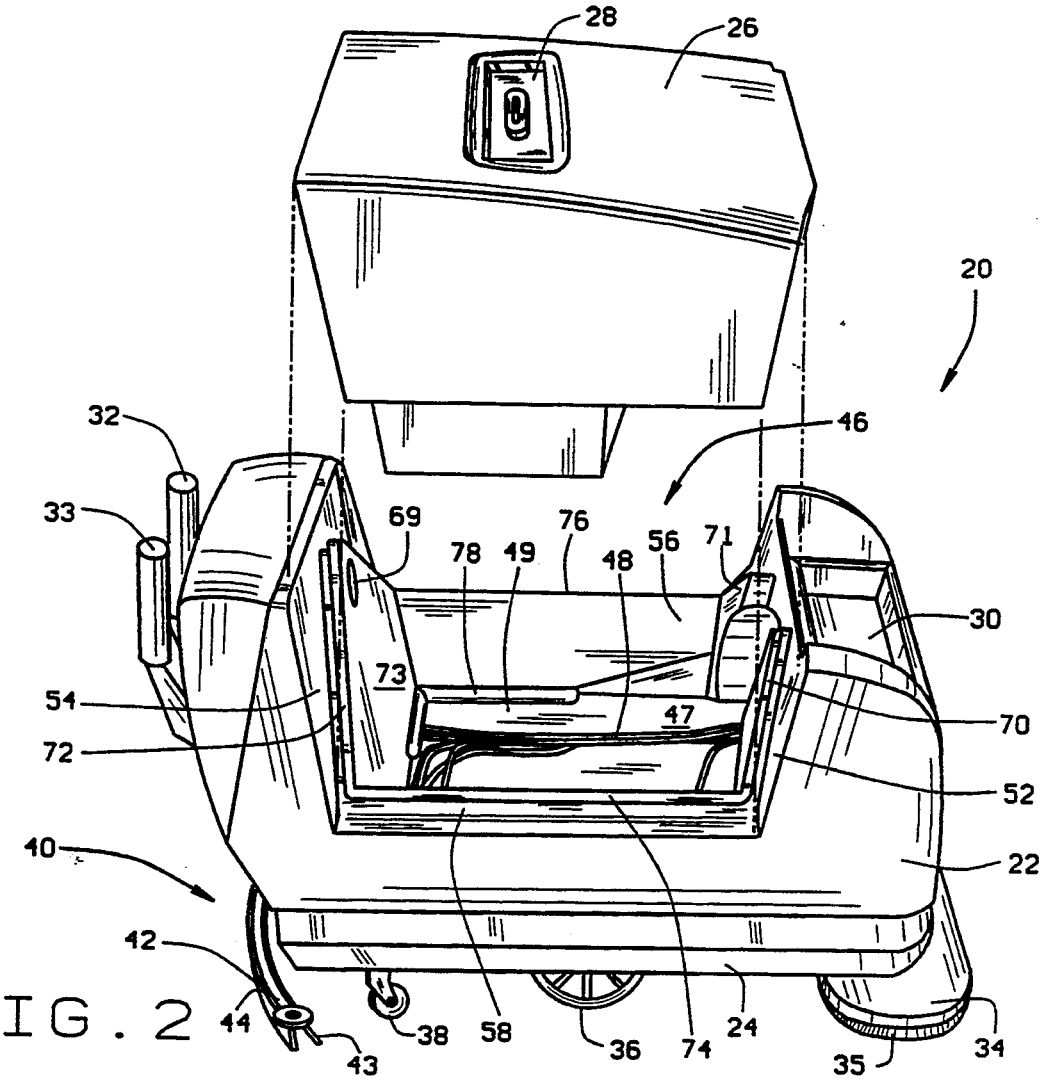
FIG. 2 is an elevational view of the floor scrubber of FIG. 1 with the secondary body defining a recovery tank in exploded view.
Figure 4:
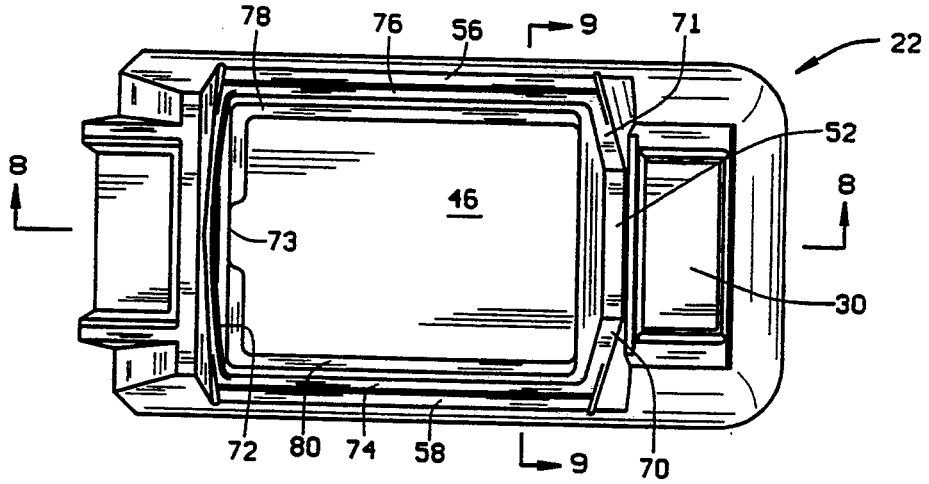
FIG. 4 is a top view of the main body of FIG. 3.

With particular reference now to FIG. 2, main body 22 includes a central opening 46 defining a cavity or space in which is disposed recovery tank 26. Opening 46 is defined by a front wall 52, a rear wall 54, a side wall 56, and a side wall 58, and is open to floor 47 of chassis 24. Also, depicted in FIG. 2 is an electrical wire bundle 48 running across floor 47 within the interior of body 22. This space houses the various components of the floor scrubber 20. Integrally formed with front wall 52 are two triangular shaped front ridges or ledges 70 and 71. Front ridges 70 and 71 are inwardly offset such that they extend a distance inward from wall 52. Each side wall 56 and 58 also includes a respective side ridge or ledge 74, 76 that are inwardly offset and which extend along the length thereof. Integrally formed with end wall 54 is a triangular offset or protrusion 73 defining a rear ridge or ledge or lip 72. Lip 72 is of an inverted V-shape and extends from side ridge 74 to side ridge 76. Thus, ridges 70, 71, 72, 74, and 76 provide a peripheral ledge or lip about the interior periphery of opening 46 and extending into the interior of the body. Disposed on the bottom of wall 56 is an inwardly extending L-shaped ledge 78. Likewise, wall 58 includes a similar ledge 80 (FIG. 4). Ledges 76 and 74 define a seating surface for recovery tank 26. Disposed in the top portion of protrusion 73 is inlet port 69.

Figure 5:
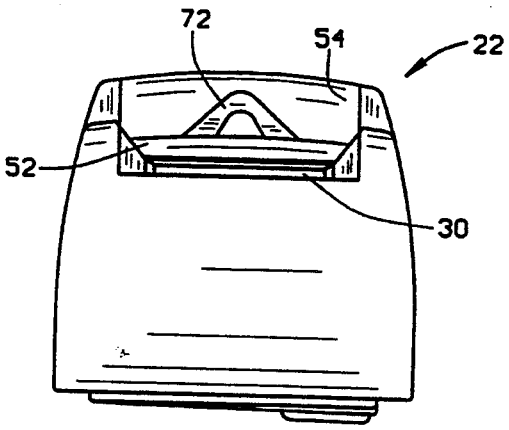
FIG. 5 is a front view of the main body.
Figure 6:
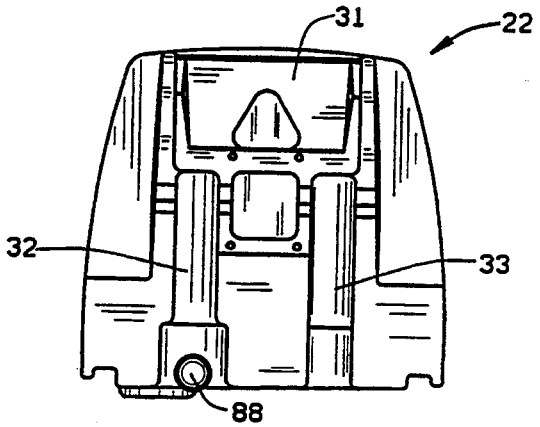
FIG. 6 is a rear view of the main body.

Referring to FIG. 4, a top view of main body 22 is depicted. As can be discerned therefrom, ridges 70, 71, 72, 74, and 76 define a peripheral lip or ledge around the interior of recovery tank cavity 46. This peripheral lip provides ½ of the interlocking feature of the present invention, which interlockingly mates with corresponding grooves in the recovery tank 26 as described hereinbelow. Furthermore, FIGS. 5 and 6 are depicted which show rear and front views of main body 22.

Figure 7:
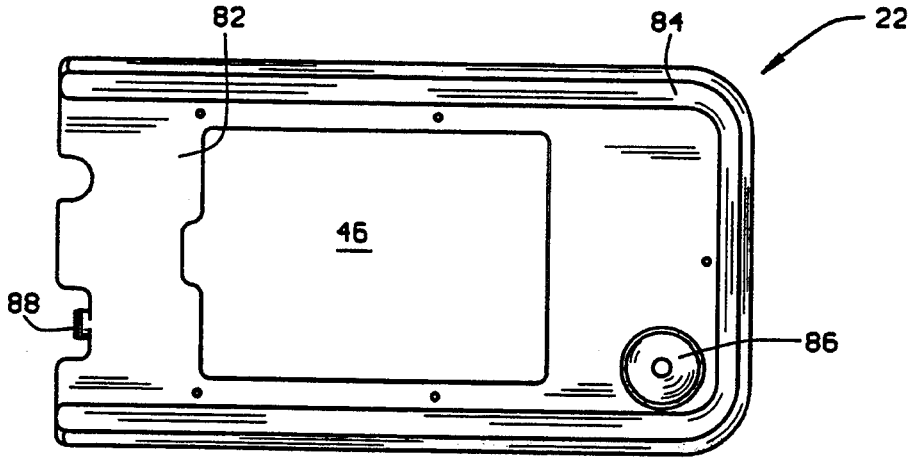
FIG. 7 is a bottom view of the main body.

Referring now to FIG. 7, there is shown the underside of main body 22. Recovery tank opening 46 extends through bottom 82. Furthermore, the underside of main body 22 includes an essentially U-shaped ridge or ledge 84 for positively seating main body 22 on the chassis. Furthermore, main body 22 includes an outlet 86 on the other side thereof for communication between the solution tank and the brush head. A port 88 is disposed on the rear portion thereof for communication with the recovery tank.

Figure 8:
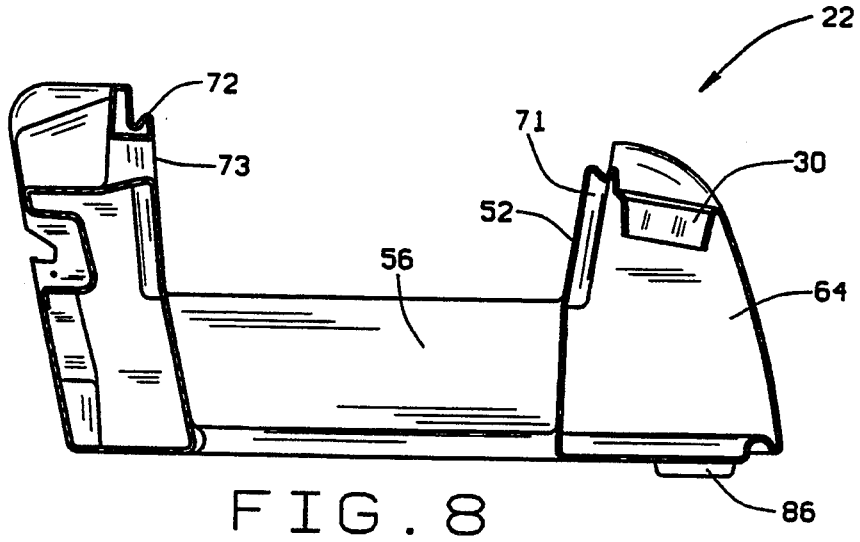
FIG. 8 is a sectional side view of the main body showing the solution tank area.
Figure 9:
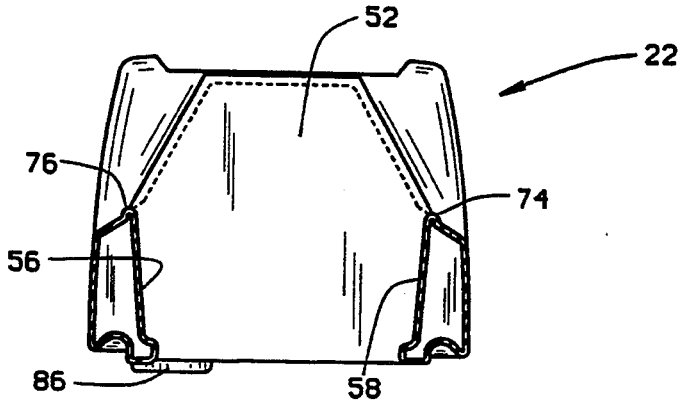
FIG. 9 is a sectional front view of the main body.
Figure 10:
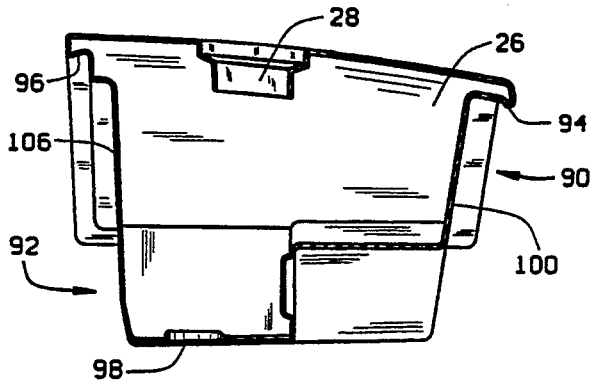
FIG. 10 is a sectional side view of the recovery tank that is depicted in exploded view in FIG. 2, taken along line 10—10 of FIG. 14.

Referring to FIG. 8, there is shown a sectional view of main body 22. From this view, it can be seen that solution tank 64 is integrally molded in the front portion of main body 22. Furthermore, it can be seen that ledge 71 and ledge 72 provide a lip for receipt of the recovery tank 26. Furthermore, FIG. 9 depicts a front sectional view of main body 22. In particular, ridges 74 and 76 of respective sides 58, 56 provide the ledge portion.

Figure 11:
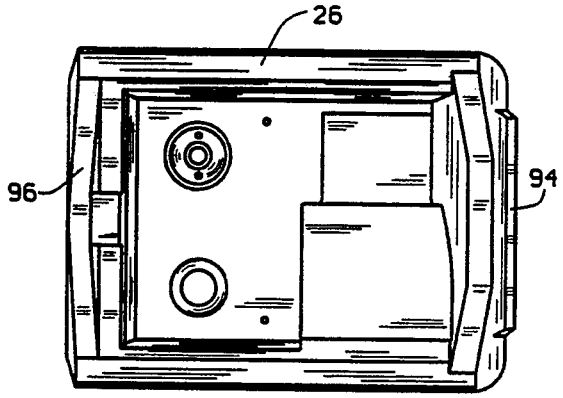
FIG. 11 is a bottom view of the recovery tank.

Referring now to FIGS. 10 through 14, there is shown several views of the recovery tank 26. As noted above, recovery tank 26 is molded as a one-piece integral tank. Although one piece, recovery tank 26 essentially includes a top portion 90 and the lower protruding portion 92. On the front end of recovery tank 26 is a downwardly projecting lip or ledge 94, while in the rear portion, a downwardly extending lip portion 96 is disposed in the top rear wall. Outlet port 98 is further disposed in recovery tank 26. Referring to FIG. 11, the forward lip 94 and rear lip 96 may be seen in detail.

Figure 12:
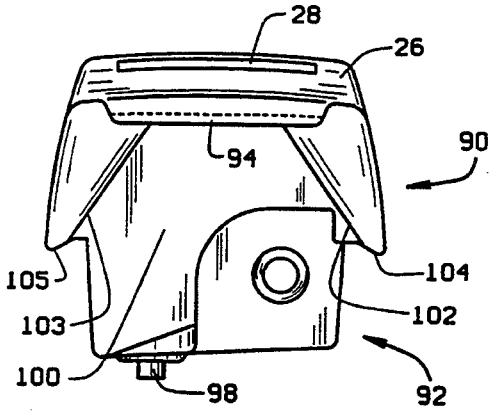
FIG. 12 is a front view of the recovery tank.
Figure 13:
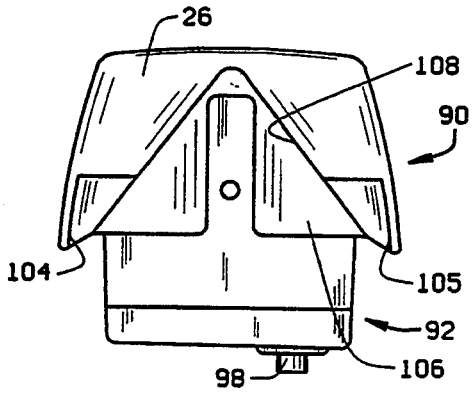
FIG. 13 is a rear view of the recovery tank.
Figure 14:
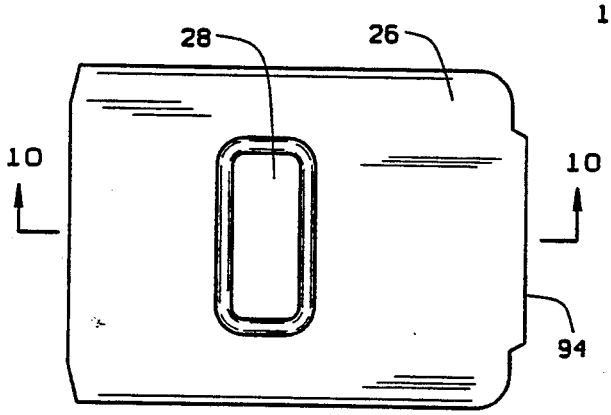
FIG. 14 is a top view of the recovery tank.

Referring to FIG. 12, the front portion of recovery tank 26 is depicted. Recovery tank 26 includes a front wall 100 which has two angled wall portions on either side thereof 102, 103 which define lips 104 and 105. Lips 104 and 105 longitudinally extend along the length thereof. In this regard, reference FIG. 13 which shows the rear view of recovery tank 26. Extending from the rear surface 106 is an inverted V-shaped ledge 108 which terminates in lips 105 and 104.

It can thus be appreciated that the lips of recovery tank 26 and the ledges of main body 22 interlockingly correlate, such that as recovery tank 26 is inserted into cavity 46, the interlocking fit of recovery tank 26 fits over the appropriate ledges 70, 71, 72, 74, 76 to form a water shedding, gasketless seal.

While the foregoing is directed towards the preferred embodiment of the present invention, other and further embodiments of the invention may be devised without departing from the basic scope thereof, and the scope thereof is determined by the claims which follow.

What is claimed is:

1. A floor washing machine for cleaning a floor comprising:

a chassis;

an on-board power system supported by said chassis;

at least one wheel powered by said power system and mounted to said chassis for supporting, carrying, and moving said chassis;

at least one brush powered by said power system and attached to said chassis for scrubbing and applying a cleaning solution to the floor;

a one-piece molded main body supported on said chassis and covering said power system, said main body having a central cavity and an integrally formed solution tank for holding the cleaning solution;

a one-piece molded secondary body defining a recovery tank, said secondary body receivable in and supported by said central cavity in an interlocking fashion;

a solution application system for transferring the solution from said solution tank to said at least one brush; and a suction system for transferring liquid on the floor to said recovery tank;

said main body and said secondary body together defining a water-shedding housing.

2. The floor washing machine of claim 1, wherein said main body includes an integrally formed solution inlet in communication with said solution tank, and an integrally formed solution outlet in communication with said solution tank and said solution application system.

3. The floor washing machine of claim 1, wherein:

said secondary body includes a recovery inlet in communication with said recovery tank, and a recovery outlet in communication with said recovery tank; and said main body includes an integrally formed inlet aperture in communication with said suction system and said recovery inlet, and an integrally formed outlet aperture in communication with said recovery outlet and an outlet conduit.

4. The floor washing machine of claim 1, wherein said central cavity includes inwardly extending ledges and said secondary body includes complementary inwardly extending surfaces adapted to interlockingly engage said ledges to form a water-shedding cover about said central cavity.

5. A self-propelled, walk-behind floor scrubber comprising:

a frame supported by a powered wheel;

a rotatable brush supported on a front portion of said frame and adapted to contact and clean a floor surface;

a one-piece molded housing supported on said frame, said one-piece molded housing having an integrally formed solution tank for storing a cleaning solution and a central opening, said one-piece molded housing further defining an interior cavity;

a one-piece molded body defining a recovery tank, said one-piece body receivable in and supported by said central opening, said central opening including inwardly extending ledges and said one-piece body including complementary inwardly extending surfaces adapted to interlockingly engage said ledges to form a water-shedding cover about said interior cavity;

a solution application system in communication with said brush and said solution tank for supplying the cleaning solution to said brush from said solution tank for application onto the floor; and a suction system in communication with the floor and said recovery tank for transferring spent cleaning solution on the floor to said recovery tank as the floor scrubber moves in the direction of said brush.

6. The floor scrubber of claim 5, wherein said one-piece molded housing includes an integrally formed solution inlet in communication with said solution tank, and an integrally formed solution outlet in communication with said solution tank and said solution application system; and said one-piece molded body including an integrally formed inlet aperture in communication with said suction system and said recovery inlet, and an integrally formed outlet aperture in communication with said recovery outlet and an outlet conduit.

7. A water-tight housing structure for a floor scrubber, the housing structure comprising:

a one-piece molded body constituting a main housing, said main housing having an opening in an upper surface thereof, and an integrally formed solution tank for storing a cleaning solution, said main housing together with a floor scrubber chassis defining an interior chamber, said opening having a lip disposed on the inner periphery thereof; and a one-piece molded recovery tank adapted to fit into and cover said opening, said tank having a rib disposed on an outside surface thereof and defining a recess, said rib and recess adapted to interlockingly engage said lip such that said body and said recovery tank form a water-shedding housing structure around said interior chamber.

8. The housing structure of claim 7, wherein said opening is defined by a first pair of opposing walls and a second pair of opposing walls, said lip extending longitudinally on said first pair of opposing walls and forming an inverted V-shape on one of said second pair of opposing walls, said rib forming an inverted V-shape on one end of said recovery tank adapted to complementarily engage said inverted V-shaped lip.

9. The housing structure of claim 7, wherein said lip forms two converging angles on the other of said second pair of opposing walls, said rib forming complementarily recesses on a front end of said tank adapted to lockingly engage said two converging angles.

* * * * *